US005201497A

United States Patent [19]

Williams et al.

[11] Patent Number: 5,201,497

[45] Date of Patent: Apr. 13, 1993

[54] END FABRIC WOVEN FENCE

[75] Inventors: Mark B. Williams, Marietta; Richard W. Carriker, Woodstock; Edward Barkis, Marietta; Larry M. Bailey, Decatur; Thomas G. Cabanis, Smyrna, all of Ga.

[73] Assignee: Amoco Corporation, Chicago, Ill.

[21] Appl. No.: 844,137

[22] Filed: Mar. 2, 1992

Related U.S. Application Data

[63] Continuation of Ser. No. 558,800, Jul. 27, 1990, abandoned.

[51] Int. Cl.[5] ..... G01F 7/02

[52] U.S. Cl. ..... 256/12.5; 256/45

[58] Field of Search ..... 428/226, 232, 241, 196; 256/12.5, 32, 45

[56] References Cited

U.S. PATENT DOCUMENTS

| | | | |
|---|---|---|---|
| 3,426,536 | 2/1969 | Dang | 256/12.5 X |
| 3,716,446 | 2/1973 | Dean | 428/226 |
| 3,871,910 | 3/1975 | Barkis et al. | 428/196 |
| 4,156,957 | 6/1979 | McKay | 428/226 X |
| 4,557,958 | 12/1985 | Barkis et al. | 428/226 X |
| 4,636,428 | 1/1987 | Bruner et al. | 428/253 XR |

FOREIGN PATENT DOCUMENTS

| | | | |
|---|---|---|---|
| 345759 | 1/1937 | Italy | 428/232 |
| 667015 | 9/1964 | Italy | 256/17.5 |

*Primary Examiner*—Dave W. Arola
*Assistant Examiner*—Heather Chun
*Attorney, Agent, or Firm*—Stephen L. Hensley; Frank J. Sroka

[57] ABSTRACT

A barrier fence comprising a leno fabric woven from thermoplastic yarns, and a series of stripes of a thermoplastic resin in a warp direction integrally adhered to the leno fabric, having gaps therebetween, wherein the stripes adhered to the leno fabric have a Tensile Strength in the warp direction at least equal to or greater than that of the gaps.

20 Claims, 2 Drawing Sheets

END FABRIC WOVEN FENCE

This is a continuation of application Ser. No. 07/558,800 filed Jul. 27, 1990 now abandoned.

FIELD OF THE INVENTION

This invention relates to fencing, and more particularly, to a fence comprising a leno fabric woven from thermoplastic yarns and a plurality of stripes of a thermoplastic resin in a warp direction integrally adhered to said leno fabric, said stripes having gaps therebetween, wherein said stripes have a Tensile Strength in the warp direction at least equal to or greater than that of the leno fabric in the gaps therebetween.

BACKGROUND OF THE INVENTION

The end use of a fence is an important consideration when designing same. In the case of barrier fences, such as are used to surround construction sites and sporting events, important end use considerations to be accounted for in the design include high visibility, sag resistance, resistance to being blow down, portability and ease in handling and installing. A barrier fence, such as disclosed in U.S. Pat. No. 4,671,495, includes slats that are attached to posts and rotate partially around the posts, or in the U.S. Pat. No. 3,426,536, the fence is built from pliable strips and posts, with the strips alternately plaited through the posts perpendicular to the ground. These fences are designed to be durable, yet neither is practical because they are not portable, flexible or easily installed.

Fences have been used for snow control purposes, such as U.S. Pat. No. 514,999 which describes a metal snow fence of broad metal bands interwoven with a metal thread and U.S. Pat. No. 3,672,638 describes a snow fence made from a wire fabric containing warp and weft wires.

Assignees U.S. patent application Ser. No. 401,993 entitled *Silt Control Fabric,* filed Sep. 1, 1989, discloses a woven silt control fabric using synthetic yarns to prevent soil run-off. Woven silt control fabrics are generally designed to have water flow capacity of about 20 of above gallons per minute per square foot of fabric (gal/min/fr$^2$), while retaining soil particles greater than 20 apparent opening size (AOS), also termed equivalent opening size (EOS). (Apparent opening size numbers correspond to U.S. sieve size; for example, a 20 AOS equals a 20 sieve and a 30 AOS equals a 30, sieve.) For example, two woven silt control fabrics sold by Amoco Fabrics & Fibers Company, and designed at Number 1380 and Number 2125 in a brochure entitled "WOVEN FABRIC SELECTION GUIDE," have water flow capacities, also called permitivities, of 30 and 15 gal/min/ft$^2$, respectively, while having an AOS of between 30 to 50 and between 20 to 30, respectively.

In an attempt to substitute materials for fencing which are not as bulky as weighty as the aforementioned barrier and snow fences, fencing products made from fibrous materials, such as nylon, polyester, cotton, and the like, have been used for crown control, snow fending, and to control soil erosion. U.S. Pat. No. 4,636,428 is directed to a knit fencing product finished with a polymeric coating adhered to the surface and impregnated into each strand, with a goal of rendering the fabric resistant to abrasion and ultraviolet light.

Plastic fences for commercial and industrial applications are available from, Tensar Polytechnologies, Inc.

Tensar sells: a Banded Fence which has three bands in the warp direction, at the top, middle, and bottom with a substrate therebetween; a Safety Barrier sheet with oblong apertures in the warp direction; a Safety Grid with narrow vertical and horizontal strips with square openings; and Tensar UX3100 and UX3200 snow fencing which appear to be similar in many respects to those previously described. A Raschel knit barrier fence with oblong openings in the warp direction is available from Weathashade Corporation.

Other patents that may be of interest in connection with the present invention are Assignee's U.S. Pat. No. 3,871,910 directed to a leno polypropylene fabric having a polypropylene copolymer print band, which is useful for making fruit and vegetable bags and Assignee's U.S. Pat. No. 4,557,958, directed to a fabric suitable for use as a cotton bale cover or bag fabric comprising a woven substrate with a series of stripes of a thermoplastic resin fused thereto.

Neither discloses or suggests fencing. The aforementioned references do not disclose the present invention nor do they address the problems solved by the instant invention, such as providing a highly visible and durable fence: (i) with superior sag resistance which substantially resists stretching during high winds and inclement weather, while being sufficiently stretchable to be pulled tautly or slightly stretched during installation for superior visibility and appearance; and (ii) with stripes having improved resistance to ripping and tearing, thereby enhancing the useful life of such fence.

It therefore would be desirable to provide an improved fence having properties such as, easy to install, bright and highly visible, economical, made of a light weight material which is ultraviolet stabilized, will not unravel or mildew, durable and resilient, light weight for easy storage and handling, flexible at high and low temperatures, and long lasting.

It is an object of the present invention to provide an improved barrier fence.

It is an object of the present invention to provide a highly visible fence with a superior appearance, including, for example, a reflective material, and light weight, easy to erect, dismantle and store.

It is also an object of the present invention to provide a fence with superior sag resistance and enhanced dimensional stability during use.

It is also an object of the present invention to provide a fence which is made of a material capable of being recycled.

These and other objects of the present invention will become more apparent from a consideration of the following description and drawings.

SUMMARY OF THE INVENTION

This invention provides a fence comprising a leno fabric woven from thermoplastic yarns, and a plurality of stripes of a thermoplastic resin integrally adhered to said leno fabric, said stripes having gaps therebetween, wherein said stripes adhered to said leno fabric have a Tensile Strength in the warp direction at least equal to or greater than that of the leno fabric in the gaps therebetween.

DETAILED DESCRIPTION OF THE PREFERRED EMBODIMENT

While this invention is susceptible of embodiments in many forms, there is shown in FIGS. 1–4 one embodiment of this invention, with the understanding that the present disclosure is not intended to limit the invention to the embodiment illustrated. For example, the width and thickness of the stripes and fence and number of such stripes, as well as the width of the gaps and number of same, can be the same or different from that shown in FIG. 1. As will become apparent from this disclosure, all such modifications fall within the scope of this invention.

Figure 1:
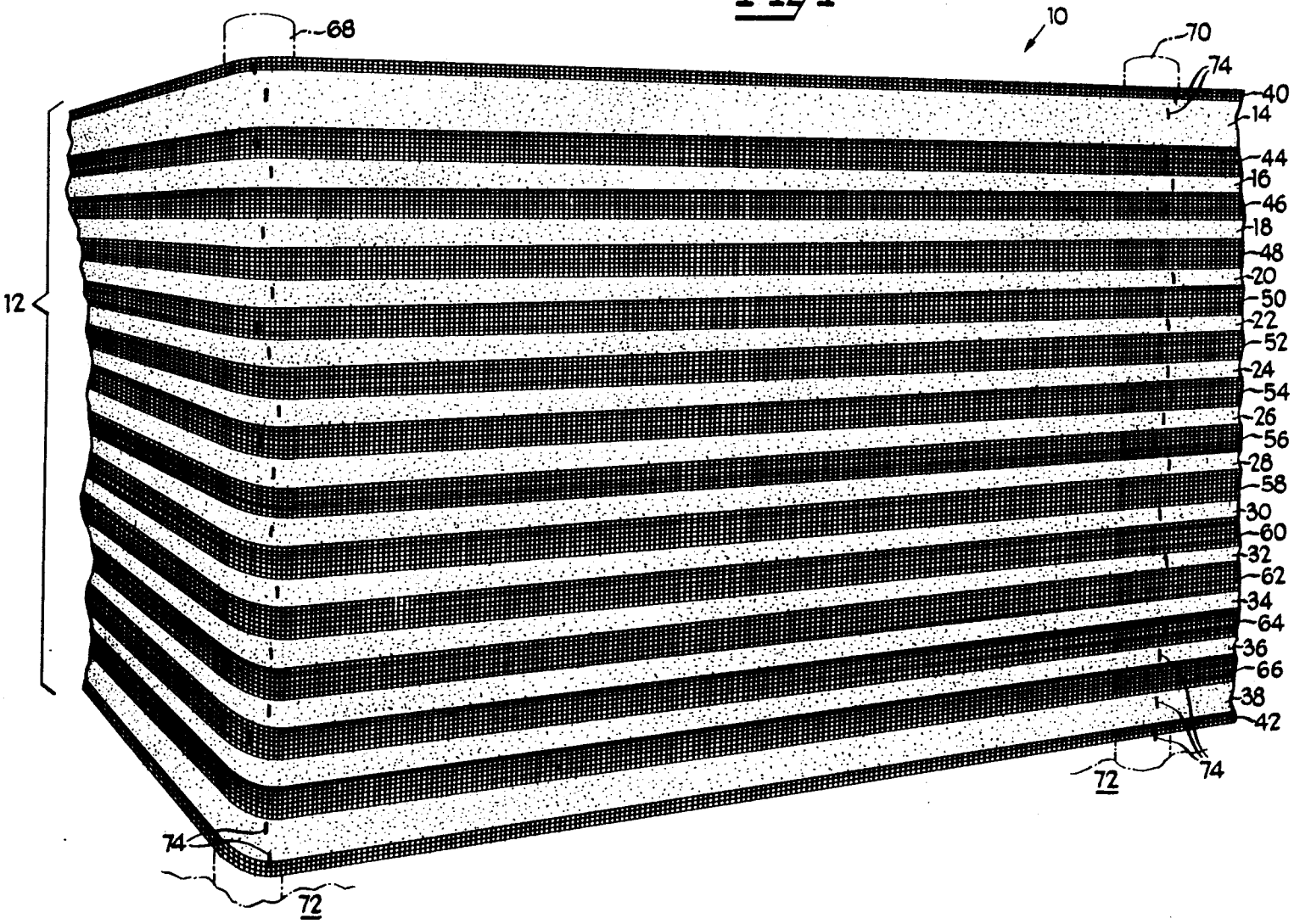
FIG. 1 is a perspective view of a fence having stripes substantially parallel to an installation surface of the present invention.
Figure 2:
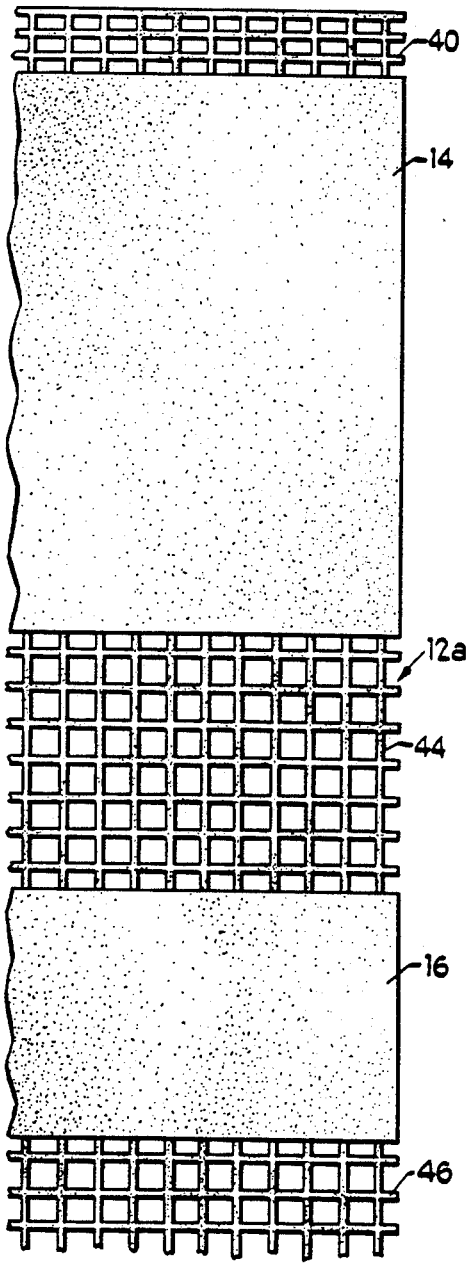
FIG. 2 is an enlarged-partial view of the fence of FIG. 1 in accordance with this invention.

Illustrated in FIG. 1 is a fence 10 comprising a leno fabric 12 woven from thermoplastic yarns and a plurality of stripes of a thermoplastic resin in a warp direction integrally adhered to said leno fabric 12, said stripes having gaps therebetween, wherein said stripes adhere to said leno fabric 12 have a Tensile Strength in the warp direction at least equal to or greater than that of the leno fabric in the gaps therebetween.

This invention is particularly well suited as a barrier fence. The stripes are securely adhered to the leno fabric 12 to substantially resist separation from the leno fabric. The fence is adapted to being stretched or pulled tautly during installation for a neat appearance, yet will resist sagging, during high winds and inclement weather. Further, the stripes are tear and rip resistant to provide improved strength and stability to the fence.

The leno fabric 12 involves a particular construction referred to as a leno weave, which is defined as a relatively loose or open weave in which the warp yarns are arranged in pairs so as to twist one around the other between picks or filling yarn, as in Marquisette.

A leno fabric 12 is advantageous over other plain weaves because of the twisting of the warp yarns around the pick yarns provides: greater dimensional stability than a relatively loose plain weave with minimal slippage or distortion; and large enough open areas to allow the wind to pass through with minimal resistance. The leno fabric 12 is generally characterized as having a substantially-regular pattern of holes defined by the yarn strands of the polymeric material. These holes or vacancies usually represent more than 50% of the total surface area of the fabric. The nominal size of the holes, the size of the holes ignoring the width of the yarn, can vary widely, preferably from approximately an eighth of an inch to a half an inch and preferably from about a sixth of an inch to a quarter of an inch. The holes are generally rectangular or square shaped for good dimensional stability and minimal wind resistance. The width of the leno fabric 12 can vary widely, for example, from about 8 to about 2 feet, and preferably about 4 feet, the standard height of a barrier fence.

The leno fabric 12 construction and yarn dimensions can vary widely, for example, the warp yarn can range from about 6 to about 24 warm ends per inch and a denier ranging from about 200 to about 800, and the fill yarn can range from about 500 to about 1400, preferably about 8 warp ends per inch and a denier of 500 by 5.5 pick ends per inch with a denier of 1000, for enhanced strength, percent open area, dimensional stability, and visibility, while being light weight. The resins used for the fabric are generally polypropylene and polyethylene such as high density polyethylene and linear low density polyethylene due to low costs, good properties and availability.

In a preferred embodiment, the leno fabric 12 comprises tape yarns. A tap yarn is made by slitting a film, such as that prepared by extruding a thermoplastic resin through a film die, and drawing the yarn thereafter to orient the same in the longitudinal direction to impart greater strength. The warp and fill yarn dimensions can vary widely. In a preferred embodiment, the fill and warp yarns can range from about 1.5 mils to about 2.5 mils by about 30 mils to about 200 mils, and more preferably, the fill yarn has a denier of about 1000 and dimensions of about $1.8 \times 105$ mils and the warp yarn has a denier of about 500 and dimensions of about $1.9 \times 50$ mils, for good strength, stability and properties. The leno fabric is made in a conventional weaving loom. The yarns can comprise fibrillated yarns for enhanced flexibility, compressibility, and strength.

Figure 3:
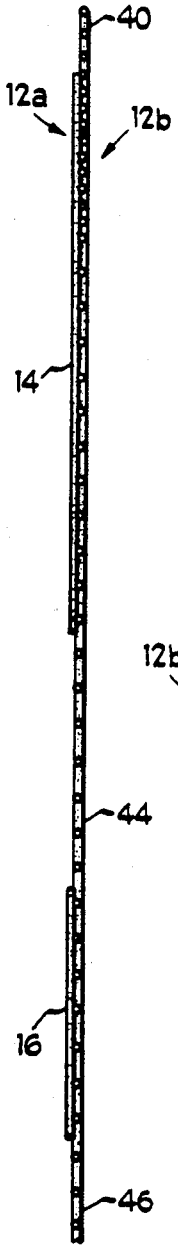
FIG. 3 is a side view of the fence of FIG. 2 in accordance with this invention.
Figure 4:
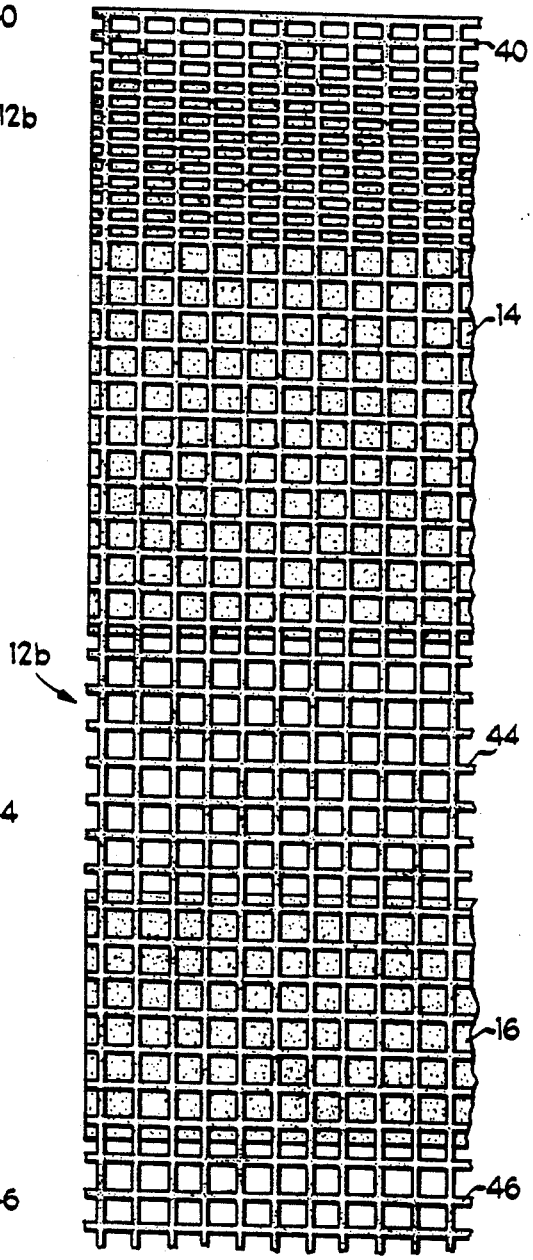
FIG. 4 is a rear view of the fence of FIG. 2 in accordance with this invention.

Referring to FIG. 3, the leno fabric 12 includes a stripe side **12*a* and fabric side 12*b*. As illustrated in FIG. 1, the plurality of stripes which are integrally adhered to the leno fabric 12, comprise a first stripe 14, a second stripe 16, a third stripe 18, a fourth stripe 20, a fifth stripe 22, a sixth stripe 24, a seventh stripe 26, an eighth stripe 28, a ninth stripe 30, a tenth stripe 32, an eleventh stripe 34, a twelfth stripe 36, and a thirteenth stripe 38. Of course, the number of stripes can vary widely. The stripes add strength and stability, as well as high visibility to fence 10. The plurality of stripes run in the warp direction and each is substantially parallel to the adjacent stripes for high visibility and aesthetics. The stripes 14, 16, 18, 20, 22, 24, 26, 28, 30, 32, 34, 36, and 38 can be integrally adhered to the leno fabric 12** by any suitable means, such as by calendering, transfer printing, laminating, adhesives, and preferably by extrusion coating for speed, economy and enhanced separation resistance. As will be appreciated by those skilled in the art, the gap and stripe widths need not be uniform, not do they require being substantially equally spaced as illustrated in FIG. 1 to fall within the scope of this invention.

In a preferred embodiment, the outermost stripes, for example, first and thirteenth stripes 14 and 38 in FIG. 1, are wider than the intermediate stripes therebetween, to provide a wide area to staple or attach the top and bottom of fence 10 to a supporting means or post. In an embodiment the outermost stripes 14 and 38 have widths which can vary greatly, for example, ranging from about 10 to about 2 inches, preferably ranging from about 6 to about 2 inches, and most preferably about 4 inches, for enhanced visibility and improved definition of the top and bottom of fence 10, as well as providing a wide area to attach or staple through fence 10 to a supporting means such as a post with enhanced resistance to tearing or ripping. The stripe areas have enhanced resistance to tearing and ripping because the stripes reinforce the leno fabric. More particularly, the stripes are integrally attached to the fabric such that the warp and fill yarns are at least partially embedded in the stripes, thereby substantially distributing and minimizing the stress and strain of each individual yarn under a load in the stripe area, as well as in proximity to the stripe area, for enhanced durability and rip resistance during installation and inclement weather. Further, the stripes held to minimize sliding or slipping of the warp and fill yarns by providing tack points where such yarns intersect and meet. Conversely, the fabric reinforces the stripes by reducing the elongation of the stripes and thereby imparting strength to the stripes for improved sag resistance. More particularly, the stripes by themselves have generally a high elongation. The combination of the stripes attached to the leno fabric, reduces the elongation to that approaching the leno alone, thereby reducing the tendency to stretch, thereby improving sag resistance.

Referring to FIG. 1, the intermediate stripes or the second through twelfth stripes 16, 18, 20, 22, 24, 26, 28, 30, 32, 34, and 36, respectively, each has substantially similar stripe widths which can vary widely, preferably ranging from about 5 to ½ inches in width, and more preferably about 3 to about ¾ inches in width, and most preferably about 2 inches wide, so as to fill about 50% of the fence 12 with stripes between and excluding the outer stripes 14 and 38, for a compromise of desirable visibility and wind resistance to significantly decrease the likelihood of the wind blowing the fence 10 down. In a less windy environment, the stripes can fill more than 50% of the fence for increased visibility, and in a windy environment the stripes can fill less than 50% of the fence 10 for less wind resistance.

The stripes can comprise a wide array of thermoplastic resins, preferably the resin is selected such that it can be extrusion coated onto the substrate or leno fabric 12 for ease of adhesion, separation resistance and economy. These can be polyethylene and polypropylene, blends of polyethylene and polypropylene, and blends of either of these resins with other copolymers. For example, the stripe resin can include a blend of polyethylene and ethylene-vinyl acrylate, or preferably a blend of polyethylene homopolymer with ethylene-methyl acrylate copolymer for good bonding. adhesion, and compatibility to and with the leno fabric 12. Preferably, the resin includes an ultra-violet stabilizer for improved ultra-violet resistance and a pigment for high visibility. The color of the pigment can vary widely, however, a preferred pigment is orange for enhanced visibility. The compositions of the leno fabric 12 and stripes should be carefully selected so as to be highly compatible with each other, for improved bonding and adhesion. For example, for polypropylene or polyethylene leno fabric 12, a preferred stripe composition includes polyethylene homopolymer, ethylene-methyl acrylate, an ultra violet stabilizer and a pigment for good adhesion.

In a preferred embodiment, the stripe resin comprises: (i) from about 95 to about 85 weight percent of a blend ranging from about 94 to about 60 weight percent, and more preferably about 75 to about 85 weight percent, polyethylene homopolymer and about 6 to about 40 weight percent, and more preferably about 15 to about 25 weight percent ethylene-methyl acrylate, for improved physical properties, a compromise of satisfactory strength and elongation, and compatibility with the leno fabric; (ii) an ultra-violet stabilizer such as, but not limited to a hindered amine light stabilizer up to about 5 weight percent, preferably about 5 to about 3 weight percent, for improved ultra-violet light resistance which does not substantially adversely affect the blend; and optionally, (iii) a pigment up to about 5 weight percent, more preferably about 5 to about 2 weight percent, pigment for high visibility which does not interrupt or interfere with the stripe resin properties. A preferable pigment from the standpoint of visibility is International Orange. This stripe resin is well suited for being printed upon, to include identifying marks, messages and the like.

Referring to FIG. 3, the coating thickness of the stripes can vary widely, and generally ranges from about 10 to about 2 mils thick, preferably from about 6 to about 2 mils, and preferably about 4 to about 2 mils thick for fence flexibility and ease of handling during and after installation, while also sufficiently thick for high visibility and a flat and resilient-rip or tear resistant area when, for example, a staple or attaching means 74 is passed therethrough or therearound to a post or support means 68 or 70.

In a preferred embodiment, the stripes can include a reflective material such as glass beads, iridescent pigments, iridescent dyes and iridescent print for improved reflection and visibility during various times of the day. Preferably, the reflective material comprises at least one of glass beads, iridescent pigments and iridescent dyes because of availability and ease of application to the stripes.

The striped areas defined by the stripes integrally adhered to the leno fabric 12, have a Tensile Strength in the warp direction which is about equal to or greater than that of the leno fabric in the gap areas, defined by the leno fabric 12 between the striped areas, to substantially withstand the elements and variable temperatures, installation. The stripe area have been constructed to be tear and rip resistant, thereby allowing the fence 10 to be slightly stretched or pulled during installation, yet sag resistant during high winds and inclement weather. In a preferred embodiment, the stripes integrally adhered to the leno fabric 12 have a Tensile Strength in the warp direction ranging from about 50 lbs to about 80 lbs, more preferably ranging from about 60 lbs to about 70 lbs, to provide a durable stripe area for attaching means 74 to supporting means 68. Below 50 lbs the fabric will tend to stretch enough thereby being too brittle and tending to tear or rip. These ranges provide a highly durable fence 10 with superior sag resistance, and which is capable of being pulled tautly or slightly stretched during installation, and the stripes provide an area with improved rip, tear, and separation and wind sagging resistance thereby enhancing the life of the fence 10.

The peak elongation at break in the warp direction of the gap and stripe areas is generally within about twenty percent of each other, and preferably substantially the same, so that during installation, inclement weather and stretching the stripes are not ripped, pulled away or separated from the leno fabric 12, for enhanced durability.

The peak elongation at break of the fabric in the gap area and the stripe areas can vary widely and is about 30% or less, for substantially similar elongation or stretching characteristics, rip and sag resistance.

Referring again to FIG. 1, in a preferred embodiment, a narrow gap section 40 adjacent to first stripe 14 is included at one end and opposite thereto is a second narrow gap section 42 adjacent to the thirteenth stripe 38, the latter would normally be adjacent to the earth's surface when installed. Gap sections 40 and 42 include a closer or tighter leno weave for improved resistance to tearing or ripping of fence 12 in proximity thereto.

As illustrated in FIG. 1, located between stripes 14, 16, 18, 20, 22, 24, 26, 28, 30, 32, 34, 36 and 38 are first gap 44, second gap 46, third gap 48, fourth gap 50, fifth gap 52, sixth gap 54, seventh gap 56, eighth gap 58, ninth gap 60, tenth gap 62, eleventh gap 64 and twelfth gap 66, respectively. These gaps have substantially uniform widths and refer to the leno fabric between the stripes. The gap widths are substantially the same to allow the air and wind to pass evenly therethrough with minimal resistance, thereby making it less likely that the fence will be blown down. The gap widths can vary widely, for example, from about 3 to about 1 inches, most preferably about 2 inches for minimum wind resistance and good visibility of the stripes. As noted above, the number of gaps and widths thereof can vary widely.

The weight of the fence 10 can vary widely. In a preferred embodiment, the fence 10 weighs about 10 oz/yd$^2$ or less, and more preferably about 4 oz/yr$^2$, for a light weight and flexible fence which is easy to handle.

Referring again to FIG. 1, supporting means 68 and 70 are spaced apart and driven into the installation or earth's surface 72 substantially perpendicular to the warp direction of fence 10. The spacing can vary widely, but is typically about 10 feet or less for enhanced visibility, appearance and durability. Supporting means 68 and 70 can comprise, for example wooden, plastic or metal posts, pipes, beams and the like which are sufficiently strong to withstand the elements. Attaching means 74 can include, but are not limited to, nails, staples, wire or plastic ties, adhesives or solvent welding for plastic posts, and the like. Such attaching means 74 are well suited for going through or around the stripes for attaching the fence 10 to the supporting means 68 and 70. For improved appearance and support the attachment means 74 attach at least the outer stripes 14 and 38 and two or more intermediate stripes of fence 10 to the support means 68 or 70. The stripe areas have been designed to be durable and rip resistant for long periods of use, despite the fact that attaching means 74 are wrapped around or penetrate through such stripes.

The fence 10 can be made by passing the leno fabric 12 under a die of a conventional extruder, for example, at a rate of about 100 to 400 feet per minute, and preferably about 100 to 200 free per minute, while the plurality of stripes are extruded onto the leno fabric 12. The stripes are made by the use of a combing means, fingers, or pattern of parallel wires, which separate or cut the extruded film into several stripes. The comb is placed in proximity to and downstream of the die head. See U.S. Pat. No. 4,557,958 for a description of such fingers. The upper limit of the speed of extrusion is determined primarily by the choice of the size of the extruder. Preferably, sufficient pigmentation is added to make the plurality of stripes highly visible. The width of the leno fabric 12 passed by the extruder die is typically about 4 feet, the normal height of a barrier fence.

More particularly, the leno fabric 12 is contacted with a metallic chill roll in proximity to where the extruded thermoplastic resin is applied, and comes in contact with the stripe side 12*a* of the leno fabric 12. A second rubber roll comes in contact with the fabric side 12*b* and acts as a cushion to push the stripe resin at least partially in the leno fabric 12, thereby improving the flexibility of such stripe areas adhered to the leno fabric 12, provides a thin striped area and improved resistance to delamination. This is accomplished by having two parallel rolls horizontally mounted and in contact with each other forming a nip. The extrusion coating is typically performed vertically downward onto the leno fabric 12 as it passes over the metallic roll. Advantageously, the pair of rolls can exert sufficient pressure at the nip, for example, about 45 psi to about 75 psi, such that visually the yarns of the leno fabric 12 can barely be seen through the stripes when viewed from the stripe side 12*a*, while the same yarns are clearly defined when viewed from the fabric side 12*b*. Using this technique, high production rates of the striped leno fence 10 result, which is durable, has good physical characteristics and is asthetically appealing.

Although various embodiments of this invention have been shown and described, it is to be understood that various modifications and substitutions, as well as rearrangements and combinations of the preceding embodiments can be made by those skilled in the art without departing from the novel spirit and scope of this invention.

EXAMPLES

Comparison A

In Comparison A, a Raschel Knit barrier fence made by Weathashade was tested. This fence includes a knit without stripes. The results are given in Table I.

Comparison B

In Comparison B, a leno fabric having 12 ends/inch by 10 picks/inch was tested. The yarns of Comparisons B-J comprised polypropylene, having the following denier and dimensions. The warp yarns were tape yarns having an average denier of 500, an average thickness of 1.9 mils and an average width of 50 mils. The fill yarns were tape yarns having an average denier of 1000, an average thickness of 1.8 mils and an average width of 105 mils. This particular fabric weighted 1.97 oz/yd$^2$ and was not striped. The results are given in Table I.

Comparison C

In Comparison C, a leno fabric having 24 ends/inch by 5 picks/inch was tested. This leno fabric weighted 1.94 oz/yd$^2$ and was not striped. The results are given in Table I.

Comparison D

In Comparison D, a leno fabric having 12 ends/inch by 6 picks/inch was tested. This fabric weighted 1.65 oz/yd$^2$ and was not striped. The results are given in Table I.

Comparisons E–J

In comparisons E–J, a leno fabric having 8 ends/inch by 5.5 picks/inch was tested. This fabric was not striped.

EXAMPLE I

A four foot wide roll of polypropylene (homopolymer which was pigmented international orange) leno fabric having 8 warp yarns per inch (4 pairs) and 5.5 fill yarns per inch was passed between a pair of rolls at a rate of 150 linear feet per minute. The two rolls were placed such that their axes were parallel to each other and horizontal. They were in contact with each other forming a nip having a pressure of 60 psi, through which the leno fabric was threaded. The leno fabric was fed through the nip, and then under a water-cooled chill roll where it was subsequently rewound.

A conventional extruder with a 70-inch die was mounted such that the extrudate was directed vertically downward onto the leno fabric as it passed over the metallic roll and prior to passing through the nip. A combining means using a series of parallel wires spaced about 3 to 3.5 inches apart for a two-inch strip and about 5 to 6 inches for a four-inch stripe, due to the neck-in value of the resin, was used to separate the extruded film into a plurality of polypropylene stripes being extruded directly onto the leno fabric. The resulting striped fabric was immediately cooled by passing between the rolls. The pressure between the rolls was adjusted such that visually the leno fabric could just barely be seen through the stripes on one side. From the other side, the leno fabric actually penetrated through a portion of the stripes.

The yarns used to make the leno fabric comprised a blend of: 837.5 lbs of a commercial polypropylene resin obtained from Amoco Chemical Company having a melt flow rate of 2 to 4 g/10 minutes according to ASTM D-1238 condition comprising a blend of polypropylene and ultraviolet stabilizer 140 available from Allied Color Industries having more than 0.1% nickel; 100 lbs of a commercial orange pigment; and 62.5 lbs. of hindered amine ultra-violet stabilizer. The warp yarns had an average denier of 500, average thickness of 1.9 mils and an average width of 50 mils. The fill yarns had an average denier of 1000, an average thickness of 1.8 mils and an average width of 105 mils.

The stripes were extrusion coated on the leno fabric with a screw-speed of 150 rpms. The composition of the stripes included 917.5 lbs of Chevron 2205 comprising about 82 weight percent polyethylene and about 18 weight percent ethylene-methyl acrylate; 20 lbs of commercial orange pigment, and 62.5 lbs of ultra-violet stabilizer 140 available from Allied Color Industries. The stripe thickness averaged 2.0 mils thick. The stripe and gap widths were each 2 inches.

EXAMPLE II

Example 2 is an average of several runs under substantially identical conditions discussed with respect to Example I, except that the stripe thickness was increased to 3.8 mils, and the orange pigment was increased to 4% or 40 lbs and the Chevron 2205 decreased to 897.5 lbs.

TABLE I

| | Tensile Strength ASTM D-4632 (lbs.) | | Peak Elon. at break (%) | | Mullen Burst Average ASTM-3786 |
|---|---|---|---|---|---|
| Example | Warp | Fill | Warp | Fill | (psi) |
| Comparison A | 34.9 | 16.29 | 69.56 | 48.40 | — |
| Comparison B | 56.30 | 92.62 | 12.02 | 26.75 | — |
| Comparison C | — | 49.06 | — | 26.99 | — |
| Comparison D | — | 60.11 | — | 15.69 | — |
| Comparison E | — | — | — | — | 136 |
| Comparison F | — | — | — | — | 138 |
| Comparison G | — | — | — | — | 136 |
| Comparison H | — | — | — | — | 142 |
| Comparison I | — | — | — | — | 142 |
| Comparison J | — | — | — | — | 134 |
| I. | | | | | |
| Stripe Area | 65.5 | 49.1 | 22.6 | 10.2 | — |
| Gap Area | 42.1 | 37.3 | 21.4 | 16.1 | — |
| II. | | | | | |
| Stripe Area | 66.87 | 53.17 | 22.5 | 17.71 | 165 |
| Gap Area | 44.7 | 43.4 | 25.11 | 18.32 | — |

The Mullen Burst Test ASTM-3786 is a method using a device known as a "Mullen Burst Tester" which applies stresses to a geotextile by use of a hydraulic system. The tester inflates a rubber diaphragm which is in contact with the geotextile and is measured in pounds per square inch. The number reported in the table is the pressure at which the sample burst.

The results of Example I and II illustrate that the Tensile Strengths ASTM D-4632 of the stripe in the warp and fill directions, are greater than that of the gap area. The Mullen Burst average ASTM-3786 is greater in the stripe area of Example II than in the leno fabrics of Comparisons E–J. These examples illustrate the improved durability, rip, sag, and tear resistance, of the fence.

That which is claimed is:

1. A fence comprising:

a leno fabric woven from thermoplastic yarns; and a plurality of stripes of a thermoplastic resin integrally adhered to said leno fabric, said stripes being separated by areas of said fabric without stripes, wherein said striped fabric is attached to a post secured to or in ground so that said stripes are substantially parallel to said ground.

2. The fence of claim 1 wherein the leno fabric comprises polypropylene yarns.

3. The fence of claim 1 wherein the gaps run in the warp direction.

4. The fence of claim 1 wherein the yarns are tape yarns.

5. The fence of claim 1 having a weight of about 10 oz/yds$^2$ or less.

6. The fence of claim 1 having a weight of about 4 oz/yds$^2$.

7. The fence of claim 1 wherein the plurality of stripes are extrusion coated to the leno fabric in the warp direction.

8. The fence of claim 1 wherein each of said stripes has a width ranging from about 10 to about ½ inches.

9. The fence of claim 1 wherein the plurality of stripes include outer stripes having a width greater than the stripes therebetween.

10. The fence of claim 1 wherein the stripes have a thickness ranging from about 10 to about 2 mils.

11. The fence of claim 1 wherein the stripes have a coating thickness ranging from about 6 to about 2 mils.

12. The fence of claim 1 wherein the area between the outer stripes comprises about 50% or more gap area.

13. The fence of claim 12 wherein the gap widths between the stripes are substantially uniform throughout.

14. The fence of claim 1 where the stripes include a reflective material selected from at least one member of the group consisting of glass beads, iridescent pigments, iridescent dyes and iridescent print.

15. A fence comprising:

a leno fabric woven from tape yarns comprising polypropylene; and a plurality of stripes of a thermoplastic resin in a warp direction integrally adhered to said leno fabric said stripes being separated by areas of said fabric without stripes, wherein said striped areas of fabric have a Tensile Strength ranging from about 80 lbs to about 50 lbs in the warp direction and said striped fabric is attached to a post secured to or in a ground so that said stripes are substantially parallel to said ground.

16. The fence of claim 15 wherein each of said stripes has a width ranging from about 10 to about ½ inches.

17. The fence of claim 15 wherein the plurality of stripes include outer stripes having a width greater than the stripes therebetween.

18. The fence of claim 15 wherein the stripes comprise polyethylene and ethylene-methyl acrylate.

19. The fence of claim 15 wherein the stripes and yarns include a pigment.

20. The fence of claim 19 wherein the pigment is orange.

* * * * *

UNITED STATES PATENT AND TRADEMARK OFFICE
CERTIFICATE OF CORRECTION

PATENT NO.: 5,201,497

DATED: 13 April 1993

INVENTOR(S): Williams, Mark B.; Carriker, Richard W.; Barkis, Edward; Bailey, Larry M.; Cabanis, Thomas G.

It is certified that error appears in the above-identified patent and that said Letters Patent is hereby corrected as shown below:

| Col. | Line | |
|---|---|---|
| 1 | 49 | "30, sieve.)" should read --30 sieve.)--. |
| 1 | 51 | "and designed at" should read --and designated as--. |
| 1 | 58 | "as bulky as weighty" should read --as bulky or weighty--. |
| 1 | 61-2 | "crown control, snow fending" should read --crowd control, snow fencing--. |
| 5 | 15 | "5 to 1/2 inches" should read --5 to about 1/2 inches--. |
| 6 | 27 | "The stripe area have" should read --The stripe areas have--. |
| 6 | 37 | "stretch enough" should read --stretch and sag too much, and above 80 lbs. the fabric will not stretch enough--. |

Signed and Sealed this

Ninth Day of May, 1995

Bruce Lehman

*Attest:*

BRUCE LEHMAN

*Attesting Officer*

*Commissioner of Patents and Trademarks*